United States Patent [19]

Hofer

[11] Patent Number: 5,000,171

[45] Date of Patent: Mar. 19, 1991

[54] SOFT FIGURE PUPPET TOY

[76] Inventor: Marc Hofer, 11, rue du Midi, 2610 Saint-Imier, Switzerland

[21] Appl. No.: 570,954

[22] Filed: Aug. 20, 1990

Related U.S. Application Data

[63] Continuation of Ser. No. 230,154, Aug. 9, 1988, abandoned.

[30] Foreign Application Priority Data

Nov. 17, 1987 [CH] Switzerland ..... 4459/87

[51] Int. Cl.[5] ..... A61F 13/00; A63H 33/00; A63H 3/00

[52] U.S. Cl. ..... 128/82; 446/27; 446/73; 446/901

[58] Field of Search ..... 446/73, 369, 374, 379, 446/385, 387, 388, 474, 901, 26, 28, 327, 72; 2/59, 61, 162, 269, DIG. 6, 208; 604/198; 128/82, 82.1, 83, 84 C, 85, 87 R, 90, 91, 94

[56] References Cited

U.S. PATENT DOCUMENTS

| | | | |
|---|---|---|---|
| 817,416 | 4/1906 | Cather | 2/59 |
| 1,007,922 | 11/1911 | Cohen | 446/72 |
| 1,571,279 | 2/1926 | Lamb | 446/369 |
| 1,641,175 | 9/1927 | Lemieux | 446/327 |
| 1,683,110 | 9/1928 | Stockbower | 446/72 |
| 1,756,084 | 4/1930 | Williams | 446/74 |
| 2,372,799 | 4/1945 | Smith | 446/72 |
| 2,459,992 | 1/1949 | Cimino | 2/59 |
| 3,293,796 | 12/1966 | Strader | 446/385 |
| 3,299,891 | 1/1967 | Smeton | 446/74 |
| 3,735,759 | 5/1973 | MacKay | 2/DIG. 7 |
| 4,208,832 | 6/1980 | Corriveau | 446/100 |
| 4,236,263 | 12/1980 | Allee | 446/72 |
| 4,280,292 | 7/1981 | Hills | 446/28 |
| 4,363,317 | 12/1982 | Broucek | 128/82 |
| 4,505,687 | 3/1985 | Munro | 446/369 |
| 4,510,928 | 4/1985 | Ackley | 128/94 |
| 4,540,378 | 9/1985 | Cusimano | 446/369 |
| 4,579,537 | 4/1986 | Leahy | 446/100 |
| 4,668,201 | 5/1987 | Stark | 441/88 |
| 4,729,751 | 3/1988 | Schiavo | 446/901 |

FOREIGN PATENT DOCUMENTS

| | | | |
|---|---|---|---|
| 1078917 | 3/1960 | Fed. Rep. of Germany | 446/72 |
| 2484854 | 12/1981 | France . | |
| 2507907 | 12/1982 | France . | |

*Primary Examiner*—Robert A. Hafer
*Assistant Examiner*—Michael Brown
*Attorney, Agent, or Firm*—Young & Thompson

[57] ABSTRACT

A toy having a principal portion (1) forming the body of a rabbit, with a head (3) and a tail (4) secured to the body. The portion (1) is provided with closure strips (2, 2') and forms a substantially tubular envelope when these strips are secured to each other. On the external surface of the portion (1) is secured a piece (6) constituting a package for drawing materials. The doll is primarily adapted to be disposed about a plaster cast for immoblizing a fractured arm or leg of a child, thereby fulfilling a psychologically therapeutic role. The toy may also be used for carrying small drawing objects.

5 Claims, 1 Drawing Sheet

FIG.1
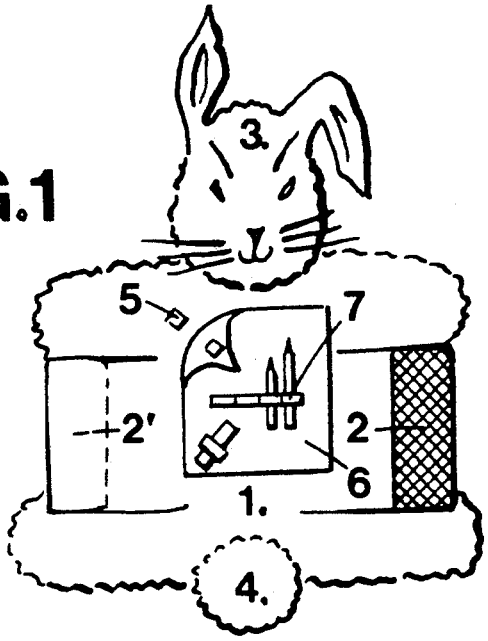
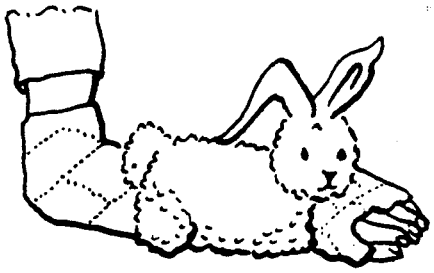
FIG.2
FIG.3
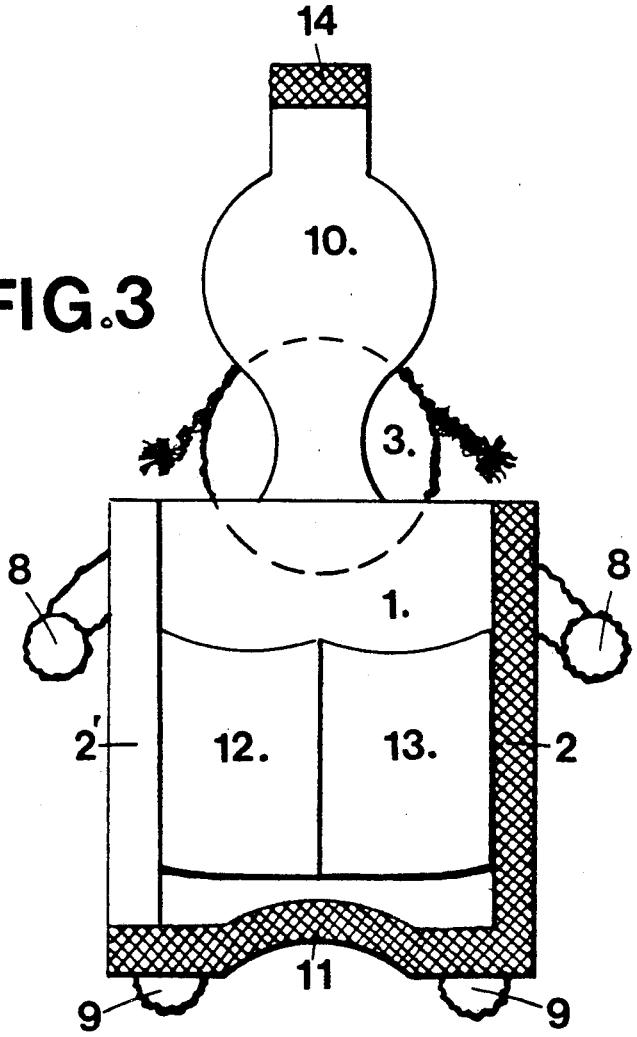

SOFT FIGURE PUPPET TOY

This application is a continuation of application Ser. No. 230,154, filed 8/9/88, now abandoned.

The invention relates to a toy, particularly a toy especially adapted for children who, because of a fractured arm or leg, have to wear a plaster cast on the fractured member for several weeks.

The traumatic effect of this immobilization on children is known. If the plaster or the like has an obvious therapeutic role, this too is difficult to accept, because it considerably limits mobility and requires quite a different way of life for several weeks.

When the infant receives such a therapeutic device, he can't understand its use or the need for it. To him, it is simply an obvious complication of his life because it restricts movement, reduces the opportunity to play in a certain sense and disturbs his sleep thanks to this "strange body" which accompanies him.

The invention seeks to minimize these negative aspects of a plaster cast by providing a toy adapted to render this plaster cast more attractive, without at the same time interfering in any way with its therapeutic role.

Moreover, the invention also has for an object to create a toy which can be used by the child even after removal of the plaster cast, so that the bond of affection established between the child and the toy when his member is immobilized will not be abruptly interrupted. To this end, the toy according to the invention is characterized in that it is so arranged as to be able to be disposed about an arm or a leg of a person and to be kept there.

Preferably, the toy will have at least two ends provided with mutual engagement means and will form a substantially tubular envelope when these two ends are secured to each other, thereby to envelop the child's member, or the plaster cast which surrounds it, and to remain on this member.

According to a preferred embodiment, the toy according to the invention will be of washable and nonflammable synthetic plush and will have a shape adapted to win the affection of the child, for example the shape of an animal or a doll, when it is fastened about the immobilizing plaster cast. The child will thus be able freely to caress his toy, which will help him bear the immobilization of his member, because he will more easily forget the principal reason for his plaster cast.

In addition to the undeniable therapeutic psychological effect of the toy according to the invention, the latter has practical advantages to the extent that it protects the plaster cast from becoming dirty. Preferably, the toy will be comprised by a principal member, adapted to form said tubular envelope, this member being extended by a portion adapted to be secured to said principal portion so as to surround the end of the fractured member. This mode of embodiment has the advantage of providing a type of muff about the plaster thereby preventing the entry of dirt into this latter and permitting keeping warm the hand or foot of the infant.

Moreover, the toy can be provided with a pocket, either internally or externally, or both, which can be used to keep little objects, for example a bus ticket or pass or a piece of identification. According to another modification, the toy may carry a small packet of crayons and other school items of small size.

By providing the ends of the toy with suitable securement means, for example fairly wide adhesive strips of the type of those available on the market under the registered trademark "Velcro", or laces, it is clear that the toy may always be secured to the arm or leg of the child, even after the plaster cast is removed, and can serve the same practical purposes mentioned above. It is easy to imagine for example the use of these toys to protect children's clothing from soiling from paint, paste, modeling clay and other school activities of the same type.

According to still another modification, the openings of the said tubular envelope may be provided with removable closure means, so as to permit use of the toy as a case. Such use is of course not limited to children and it is perfectly conceivable to use such a case for carrying a small emergency medical kit or objects of dental hygiene, or also for example clothing objects.

Other advantages and features of the toy according to the invention will follow from the characteristics set forth in the attached claims and the following description, setting forth in detail and with the help of drawings showing schematically and by way of example an embodiment and modifications of the invention.

FIG. 1 is a plan view of an embodiment of the toy according to the invention.

FIG. 2 shows a toy, of the type represented in FIG. 1, applied to an arm of an immobilized child.

FIG. 3 is a plan view of the internal surface of a modification of the toy according to the invention.

FIG. 1 shows a toy, preferably of plush, whose external appearance is that of a rabbit. The toy comprises a principal portion 1 of substantially rectangular shape, adapted to form the body of the rabbit. This principal portion comprises essentially three parts, of which two form the legs of the rabbit, the third part being disposed between the two mentioned parts and bordered by two securement strips 2, 2', for example of the type of those which are available on the market under the registered trademark "Velcro". On the external surface of the portion 1 are secured a head 3 and a tail 4, fixed to the body of the rabbit (portion 1) by suitable securement means. For example, they can be secured by adhesive strips of the mentioned type provided on the body 1 and on the corresponding surface of the head 3 and of the tail 4, or alternatively they can be quite simply sewed to said body.

The central part of the portion 1 has four small square adhesives 5 adapted to permit securement of a sheet 6 provided with elastic loops 7 (or small compartments) permitting keeping crayons, erasers and other small drawing materials. Of course, the sheet 6 may be directly sewn on the portion 1, or secured by other means for example pressure snaps. Moreover, it can be sewn in such a way as to form also a pocket, provided or not with a closure.

The mutual securement of the strips 2, 2' permits placing the rabbit about an arm of a child immobilized in a plaster cast, as shown in FIG. 2. The head of the rabbit may be oriented either to face the child or in the opposite direction. The principal portion 1 thus forms a substantially tubular envelope maintained on the plaster cast by suitable superposition of the strips 2 and 2'. These latter can be relatively wide, so as to permit a certain variation in the internal circumference of the envelope so as to permit it to be adapted to plaster casts of different dimensions and, in particular, to the child's member once it has been freed from its plaster cast.

Preferably, the toy shown will be substantially in washable non-flammable synthetic plush, the head 3 and the tail 4 being stuffed to make them protrude from the body. It is clear that the principal portion 1 could be a single member, for example completely rectangular, the rabbit ears then being secured to this portion in the same manner as the head 3 and the tail 4 and also being stuffed.

Other toys of the same type can be provided, of different shapes, as for example in the form of dolls, animals of all types, automobiles. Moreover, the toy can be attached either to an upper member or to a lower member, its function being essentially to permit the child more easily to accept his immobilized member.

FIG. 3 shows a modification of the invention, seen from its inner side. The toy in the form of a doll has a principal portion 1 substantially rectangular and bordered by adhesive strips 2, 2'. The arms 8, legs 9 and head 3 of the doll are secured to the external surface of the portion 1 as described above and will be preferably stuffed. The lower edge of the internal surface of the portion 1, opposite the head 3 of the doll, is provided with a closure strip 11, which can be an adhesive strip of the type already mentioned. This strip 11 permits forming the lower opening of the doll when it is desired to use it as a case. Alternatively, to this strip can be attached a member forming a bottom, not shown in the drawing, also of plush, for example, and provided with a securement strip of the same type. The internal surface of the portion 1 comprises also two pockets 12, 13, for example of cloth, adapted for holding objects. These pockets will be normally stitched to the portion 1, but they could of course be made removable.

The principal portion 1 is extended by a portion 10 having a securement strip 14 adapted to be secured to a strip of the same type provided on the external surface of the portion 1. When the toy surrounds the plaster cast or the covering garment, for example the arm of the infant, the strips 2 and 2' will be secured to each other, the portion 10 covering the hand of the infant forming a type of muff when the strip 14 is secured to the portion 1.

This embodiment of toy according to the invention has the advantages of keeping the hand (or the foot) of the child warm and protecting the plaster cast in an effective way. Moreover, the toy can also be advantageously used to replace in winter the gloves normally worn by children. The pockets 12 and 13, which will normally be empty when the toy surrounds the member of a child, become very useful for carrying for example children's snacks, a clothing article, or other objects, when the toy is used as a case.

The doll could also be provided on its external surface with an accessory of the type of a mounting sheet shown in FIG. 1. Moreover, it is possible to secure the head 3 of the doll on the portion 10. According to another modification, this head 3 itself forms the portion 10. In this case, the head 3 would be only partially stuffed.

It is evident that the invention is not limited to the embodiments shown and described above. In particular, the shape of the toys may be varied as desired, provided only that the appearance of the toy be engaging and attractive to the child.

The washable non-flammable synthetic plush is particularly adapted to be the basic material of the toy, but clearly this latter may be made of other fabrics, provided only that they meet the usual safety standards for toys. Moreover, the toy may be of elastic plush or may include an elastic strip.

Of course, the compartments, whether exterior or interior, for the transportation of objects may be more numerous and disposed differently than those shown. They are normally formed from resistant sheet material or from another material lending itself to the described aim.

The securement means may be other than adhesive strips of the described type. Laces may be employed, the portion 1 then having ends provided with eyelets.

The toy according to the invention, although particularly adapted to soften the traumatic effects that a member immobilized by a plaster cast has on a child, is nevertheless of quite varied utility, because it can accompany the child in many other circumstances.

Also, its use will be seen not to be restricted to children, as many adults like plush, particularly for their automobiles. It can thus be used as a case for carrying for example a small emergency medical kit.

Another particularly interesting application of the toy according to the invention is its use in schools or kindergartens as an article for protecting the clothing of children or adults working there. Thus, the very simple shape of the toy and its base material permit very easy fabrication at low cost. Moreover, it will be much easier to wash two small toys, which need no ironing, than a garment. The toy may protect for example wounds to the knees.

Finally, it is clear that the envelope provided by the toy when its ends are secured to each other may easily be filled by the child's mother, if the latter would like to make a stuffed plush or a classical type doll.

I claim:

1. An envelope for a medical cast, comprising a substantially rectangular envelope of flexible material having the appearance of a doll having a body and a head and at least one nether appendage, and means along first opposite edges of said rectangular envelope for releasably retaining the envelope wrapped about a said cast with said first opposite edges of the envelope releasably secured to each other, whereby the envelope can be applied to the cast by placing the cast in casting with an open said envelope, wrapping the envelope about the cast until said first opposite edges of the envelope overlie each other, and releasably securing together said opposite edges of the envelope, said envelope having second opposite edges extending between ends of said first opposite edges, said head extending beyond said envelope from one of said second edges and said at least one nether appendage extending beyond said envelope from the other of said second edges.

2. An envelope according to claim 1 having supplemental securement means to close one end of the envelope thereby to form a muff for protection of a limb bearing the cast surrounded by the envelope.

3. An envelope as claimed in claim 1 which has plush limbs as well as a stuffed plush head.

4. An envelope according to claim 1 having at least one pocket for retaining objects therein.

5. An envelope according to claim 1 in which said releasably retaining means comprise fastening strips of hook and loop material along said first opposite edges of said rectangular envelope.

* * * * *